United States Patent [19]

Davis et al.

[11] Patent Number: 4,842,164

[45] Date of Patent: Jun. 27, 1989

[54] STRIPED PASTE DISPENSER

[75] Inventors: Adrian F. Davis, Weybridge; Peter R. Watt, Betchworth, both of England

[73] Assignee: Beecham Group p.l.c., England

[21] Appl. No.: 66,823

[22] Filed: Jun. 25, 1987

[30] Foreign Application Priority Data

Jun. 26, 1986 [GB] United Kingdom ..... 8615670

[51] Int. Cl.[4] ..... B65D 35/22

[52] U.S. Cl. ..... 222/94; 222/107

[58] Field of Search ..... 222/92, 94, 107, 129, 222/145, 547, 564; 239/418

[56] References Cited

U.S. PATENT DOCUMENTS

| | | | |
|---|---|---|---|
| 1,535,529 | 4/1922 | Hopkins | 222/94 |
| 1,566,218 | 12/1925 | Leland | 424/51 |
| 1,698,404 | 1/1929 | Hopkins | 222/94 |
| 2,218,092 | 10/1940 | Nitardy | 222/94 |
| 2,297,690 | 10/1942 | Nitardy | 222/94 |
| 2,789,731 | 4/1957 | Marraffino | 222/94 X |
| 2,873,887 | 2/1959 | Spero | 222/94 |
| 2,905,364 | 9/1959 | Marraffino | 222/94 |
| 2,914,220 | 11/1959 | marraffino | 222/145 |
| 2,918,199 | 12/1959 | Marraffino | 198/405 |
| 2,925,939 | 2/1960 | Spero | 222/145 |
| 2,926,818 | 3/1960 | Spero | 222/135 |
| 2,935,231 | 5/1960 | Paull et al. | 222/94 |
| 2,944,704 | 7/1960 | Taylor, Jr. | 222/94 |
| 3,002,658 | 10/1961 | Sajda | 222/94 |
| 3,135,428 | 6/1964 | Gallo, Sr. | 222/145 X |
| 3,175,731 | 3/1965 | Ellman | 222/194 |
| 3,217,931 | 11/1965 | Farrar et al. | 222/94 |
| 3,331,535 | 7/1967 | Jarvis | 222/94 |

FOREIGN PATENT DOCUMENTS

| | | | |
|---|---|---|---|
| 891027 | 3/1962 | United Kingdom . | |
| 962757 | 7/1964 | United Kingdom . | |
| 1325425 | 8/1973 | United Kingdom | 222/145 |

*Primary Examiner*—Michael S. Huppert

*Attorney, Agent, or Firm*—Jacobs & Jacobs

[57] ABSTRACT

A nozzle insert for a nozzle of a striped paste dispenser has a hollow cylindrical body through which a first pasty material may be dispensed, the external surface of the hollow body having circumferentially spaced apart plateaus separated by grooves through which a second pasty material may be dispensed, the body preventing contact between the two pasty materials downstream of the discharge end of the insert.

11 Claims, 2 Drawing Sheets

STRIPED PASTE DISPENSER

Figure 1:
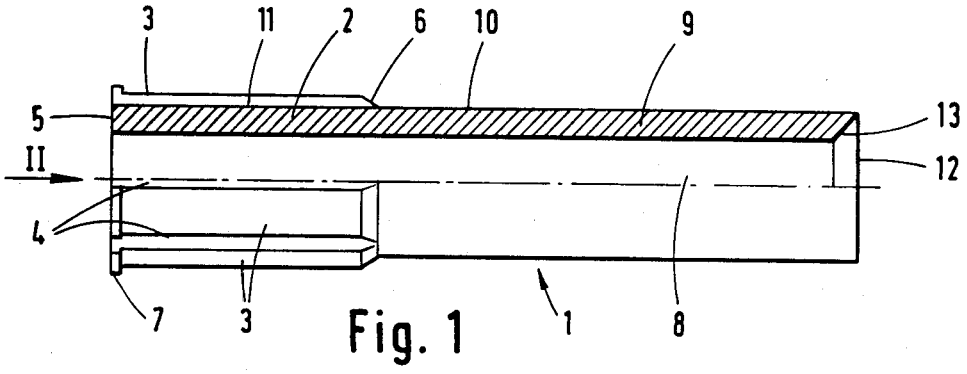

The present invention relates to a dispensing device, and in particular to an insert for the nozzle of a squeezable tube or other dispenser which enables two different pasty materials to be extruded from the tube or dispenser simultaneously in the form of a striped paste.

Numerous nozzles and nozzle inserts for dispensing two separate pasty materials from a squeezable tube in the form of a striped paste have previously been described. Many such nozzles and nozzle inserts have to be produced by complicated injection moulding techniques in order to function effectively, and are therefore relatively difficult and expensive to make. Furthermore, in many such nozzles and nozzle inserts, the striping paste material is extruded into the main stream of paste material upstream from the main outlet orifice, with the result that the two pasty materials will be in physical contact with each other in the nozzle region of the dispenser. This can be particularly disadvantageous if the pastes are mutually reactive.

The present invention now provides a nozzle insert for a squeezable tube or other dispenser to dispense a striped paste therefrom, comprising an open-ended hollow cylindrical body, at least a part of the external cylindrical surface of which is formed with a plurality of raised axially extending, circumferentially spaced plateau regions separated from each other by grooves, the said plateau regions and grooves extending to the external end of the insert.

The nozzle insert according to the present invention is structurally simpler and easier to make than known inserts, and it maintains the two pastes physically separated in the nozzle region of the dispenser, thereby avoiding chemical or physical reaction between the two pastes.

In the nozzle insert according to the invention, preferably, only a first axial part of the insert carries the said plateau regions and grooves, and a second axial part has a smoothly cylindrical external surface. The second axial part preferably constitutes the remainder of the insert. Advantageously, the axial length of the first part of the insert is at least as great as the axial length of the nozzle into which it is to be inserted. Also, advantageously, the axial length of the second part is greater than that of the first part.

Preferably, a line extending longitudinally along the bottom of each groove of the first part of the nozzle is co-linear with the outer surface of the second part of the insert.

The interior of the insert is preferably smoothly cylindrical throughout its length, but may be outwardly chamfered at the internal end of the insert, that is to say at the end remote from the plateau regions. Alternatively, the interior wall of the insert may, for example, be fluted.

The grooves and plateau regions may be parallel-sided or may have tapering sides. In the latter event, the grooves and plateau regions respectively will taper in opposite directions; for example, the grooves may narrow toward the external end of the insert while the plateau regions will narrow, optionally to a knife-edge, away from the external end.

The number of grooves and plateau regions in the first part of the nozzle can vary within wide limits, but there will normally be from 2 to 12, preferably from 4 to 10, and more preferably from 6 to 8, equally sized grooves, and a corresponding number of equally sized plateau regions.

The relative dimensions of the grooves and plateau regions, and the internal volume of the insert can also vary widely. The ratio of the total cross-sectional area of the grooves (as measured at the external end) to the internal cross-sectional area of the insert is preferably from about 1:12 to 1:2, more preferably from about 1:5 to 1:3.

When the insert according to the invention is located within the nozzle of a squeezable tube or other dispenser, the first part of the insert is advantageously substantially contained within the nozzle, while the remainder of the insert projects from the base of the nozzle into the interior of the dispenser. The insert is suitably placed into position by being inserted through the mouth of the nozzle, the second part (or interior end) of the nozzle being inserted first, until the external end of the insert is substantially flush with the external end of the nozzle.

In order to facilitate the placing of the insert nozzle, the junction between each plateau region and the smoothly cylindrical external surface of the second part of the insert is preferably chamfered at an appropriate angle, most suitably from 30° to 60°. By ensuring that the external diameter of the insert, as measured across the plateau regions, is very slightly greater than the internal diameter of the nozzle into which it is to be inserted, a very tight fit can be obtained so that the insert will not work free during use. The fit is assisted by making the insert from a resilient plastics material, such as Delrin (trade mark), Nylon (trade mark) or polythylene, which will radially compress slightly during insertion.

In addition, the external end of each plateau region preferably carries an out-turned lip. Such lips together constitute a broken annular lip to abut the top edge of the nozzle or to abut an annular projection within the nozzle mouth, when the insert is fully inserted into the nozzle, thereby preventing the insert from being pushed too far into the dispenser.

In a further aspect of the present invention there is provided a dispenser for pasty material, having a nozzle provided with a nozzle insert according to the invention, the dispenser being designed to dispense a first pasty material through the grooves of the insert and a second pasty material through the centre of the insert. The first pasty material will thus be extruded as stripes on the second pasty material.

Preferably, the dispenser is a squeezable tube, which may be formed conventionally of aluminium or plastics material. It may be filled in a conventional manner through the open base of the tube, first with a sufficient amount of the first pasty material (the striping paste) to fill the tube around the base of the nozzle up to the interior end of the insert, and then secondly with a second pasty material (the main paste body), on top of the first pasty material up to the base of the tube.

Advantageously, a barrier is placed between the two pastes so as to avoid any chemical or physical interaction. The barrier may be in the form of a plastics or aluminium foil diaphragm. Advantageously, the barrier is in the form of a substantially cylindrical plastics seal having a closed end with a hole therein through which the interior end of the insert projects, the seal being anchored around the said interior end. The cylindrical wall of the seal will be pushed against the inside wall of the dispenser when the main paste body is forced against the striping paste, thus maintaining the barrier between the two pastes. Other suitable barriers include, for example, a layer of an inert gel material. The barrier should suitably be flexible or otherwise capable of transmitting pressure, such that pressure exerted to squeeze the tube is transmitted not only to the main paste body, but is also transmitted through the barrier to the striping paste, so that both pastes are extruded.

Other forms of dispenser which may incorporate the nozzle insert according to the invention include, for example, the pump dispensers described in European Patent Application, Publication No. EP 0 084 638A.

The dispenser is suitably provided with a nozzle closure, for example a screw cap. The closure advantageously forms a seal across the end of the nozzle insert, such that when the closure is in position there is no communication between the grooves and the centre of the insert, and thus no communication between the two pasty materials.

The volume ratio of striping paste to main paste body in the dispensed or extruded product is affected by a number of factors, including the relative viscosities of the pastes; the ratio of the total cross-sectional area of the grooves to the cross-sectional area of the interior of the insert; the individual cross-sectional areas of the grooves; whether the grooves are tapered; the number of grooves; and the nature of the interior surface of the insert.

It has been found that the proportion of striping paste extruded depends not only on the total cross-sectional area of the grooves, but also on the number of grooves making up that total cross-sectional area or, in other words, on the individual cross-sectional areas of the grooves. In general, a higher proportion of striping paste will be extruded through a smaller number of larger grooves than through a larger number of smaller grooves of the same total cross-sectional area. It is thought that this results from the higher surface tension arising with smaller grooves.

It has also been found that the proportion of main paste body extruded through the centre of the insert can be reduced, for example, by fluting the interior channel, thus increasing resistance to the flow of the material therethrough.

The relative viscosities of the two pastes will also affect the proportions extruded and may be adjusted to provide the optimum dispensing characteristics. It has been found that the ratio of the viscosity of the striping paste to that of the main paste body should preferably be from about 1:2 to 1:1, more preferably about 2 to 3.

If the striping paste exhibits thixotropy, it may be necessary to adjust the relative resistance to flow imparted to the two pastes by the nozzle insert to prevent solely the main paste being extruded. This may be achieved, for example, by increasing the resistance to flow through the interior of the insert (for example, by fluting as mentioned above) and/or by decreasing the resistance to flow through the grooves (for example, by tapering the grooves to widen toward the base of the nozzle).

One of the advantageous features of the insert of the present invention is that the proportions of striping paste and main paste in the dispenser can be varied within wide limits, simply by varying the length of the part of the insert projecting from the base of the nozzle into the dispenser body. It is merely necessary that the amount of striping paste filled into the dispenser does not extend beyond the interior end of the insert. The ratio of the volume of striping paste to main paste in the dispenser is preferably from 1:12 to 1:2, more preferably from 1:5 to 1:3.

The nozzle insert according to the invention provides a particularly simple method of extruding striped pastes, and has the advantage of being particularly easy to manufacture and assemble. It may be used for the extrusion of any striped pasty materials (including any semi-viscous materials of paste-like consistency, such as creams and gels), for example toothpastes. It has particular use where it is desired to maintain the two paste components entirely separated until extrusion, because a closure across the top of the nozzle insert will provide an effective seal between the outlets for the two paste bodies.

The nozzle insert to the invention is particularly suitable for extruding the two phases of the topical pharmaceutical composition described in European Patent Application, Publication No. EP 0 151 953 A. One phase of that composition, in cream or gel form, may constitute the main paste body, while the second phase constitutes the striping paste. The extruded striped stream may be applied topically to the patient and the two phases may then be mixed in situ to give the desired super-saturated drug system.

Figure 2:
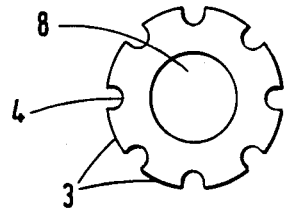
Figure 3:
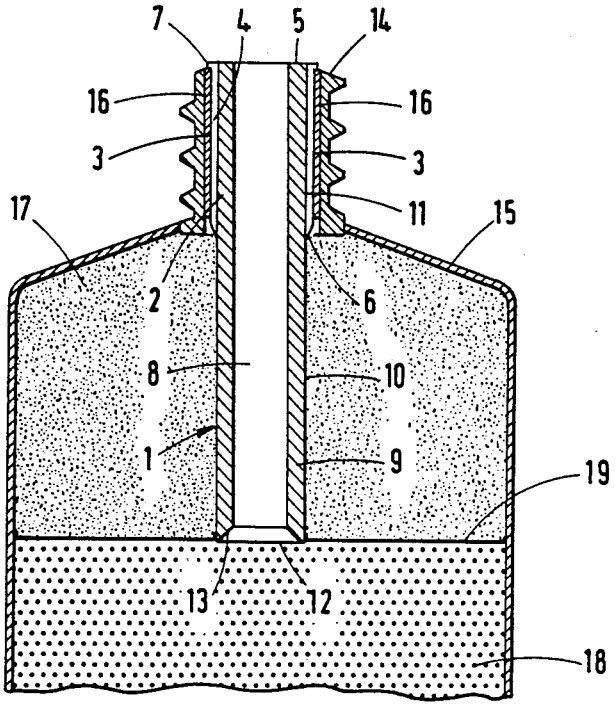
Figure 4:
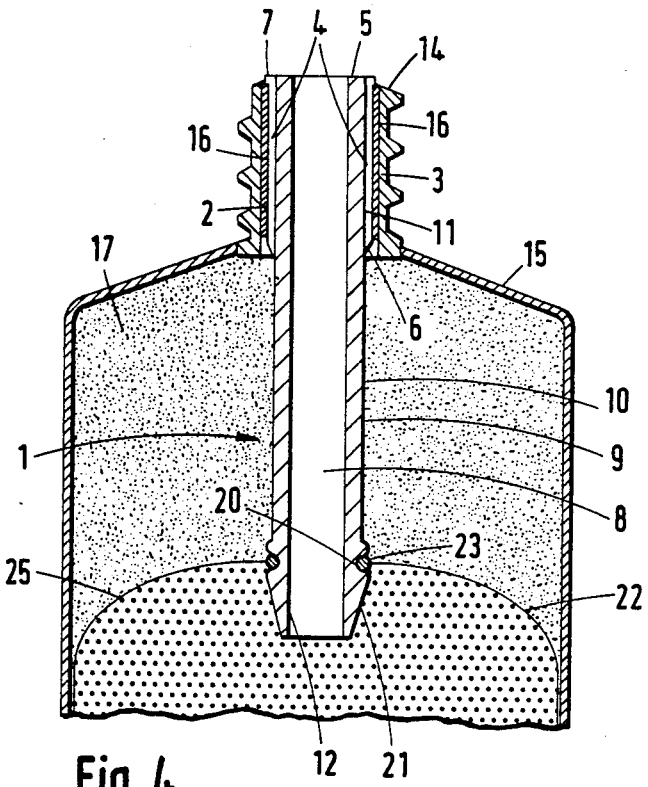
Figure 5:
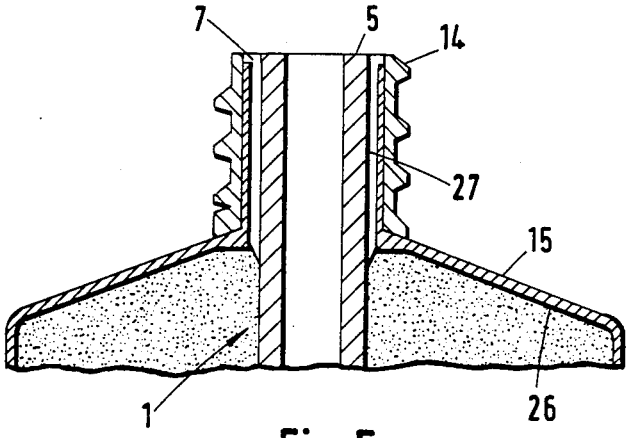

The invention will now be described, by way of example only, with reference to the accompanying drawings, in which like numerals denote like parts throughout the several views, and in which:

FIG. 1 shows a side elevation, partly in cross-section, of one form of nozzle insert according to the invention; FIG. 2 is a plan view, in the direction of arrow II, of the insert shown in FIG. 1; FIG. 3 is a cross-sectional view through part of a squeezable tube containing the insert shown in FIGS. 1; FIG. 4 is a view similar to that of FIG. 3, but showing a second form of nozzle insert according to the invention; and FIG. 5 is a view similar to that of FIG. 3 but with a slightly modified nozzle arrangement.

Referring to FIGS. 1 and 2, a nozzle insert 1 is in the form of an open-ended hollow cylindrical body of synthetic plastics material, such as Delrin (trade mark), Nylon (trade mark) or polyethylene. A first part 2 of the insert 1 is formed with eight raised axially extending, circumferentially spaced, parallel sided, plateau regions or ribs 3, each adjacent pair of plateau regions 3 being separated by a groove 4 having a smoothly curved interior wall. The plateau regions 3 and grooves 4 are symmetrically disposed around the exterior of one end of the insert 1, and they extend to the proximal end face 5 of the insert. The grooves 4 are all of equal sizes, as are also the plateau regions or ribs 3, as may clearly be seen in FIG. 2. The top wall of each plateau region 3 is curved, the centre of curvature being the same as that of the main body of the cylindrical insert 1.

Each plateau region 3 extends longitudinally from the exterior end face 5 of the insert 1 for a distance just over a third of the total length of the insert 1, and each terminates in a chamfer 6 inclined to the outer cylindrical wall of the insert 1 at an angle of about 30°. At the exterior distal or end 5 of the insert 1 each plateau 3 carries an out-turned lip 7.

A second part 9 constitutes the remainder of the insert 1 and has a smoothly cylindrical outer wall 10 which is co-linear with a line 11 extending along the bottom of each groove 4.

The interior of the insert 1 is a smoothly cylindrical passage 8 open at both ends, and outwardly chamfered 13 at the interior end 12, at an angle of about 45°, to encourage a smooth flow of paste material into the central passage 8. The ratio of the total cross-sectional area of the grooves 4 to the cross-sectional area of the passage 8 is, in this embodiment, about 1 : 3.

Referring now to FIG. 3, the insert 1 is shown positioned within a nozzle 14 of a squeezable aluminium tube 15. The insert 1 has been inserted into the nozzle 14, with the interior end 12 leading, until the chamfers 6 contacted an internal plastics sleeve 16 in the nozzle 14 when some resistance to the insertion movement was experienced. With further pushing, the plateau regions 3 were forced into the sleeve 16, guided by chamfers 6, and, being slightly oversized, were deformed radially inward while the sleeve 16 deformed radially outwardly thereby providing a tight push fit. The limit of travel of the insert 1 was restricted by the lips 7 abutting the external end of the sleeve 16. The tube 15 then was filled from the open base end (not shown) first with striping paste material 17 around the base of the nozzle 14 up to the interior end 12 of the insert 1, and thereafter a main paste body 18 was filled into the remainder of the tube 15 after the insertion of a thin, flexible plastics diaphragm 19 at the interface between the pastes 17 and 18 to avoid interaction between them.

As can be seen in FIG. 3, the axial length of each plateau region 3 and groove 4 is substantially the same as that of the nozzle 14, although it is possible for the plateau regions 3 and grooves 4 to extend further into the squeezable tube 15 without losing striping definition.

The axial length of the second part 9 of the insert 1 is about one-quarter of the length of the dispenser (measured from the base of the nozzle 14) which will generally give a volume ratio of striping paste 17 to main paste 18 in the dispenser of the order of about 1:3, depending on the size and shape of the tube.

In order to dispense a striped stream of paste, the tube 15 is squeezed, preferably from the bottom. This forces main paste body 18 into the passage 8, guided by chamfer 13. Simultaneously, the squeezing force is transmitted from the main paste body 18, through the diaphragm 19 to the striping paste 17 which is thus pushed through the grooves 4 and issues from the mouth of the nozzle 14 as eight stripes on the main paste body 18 being extruded simultaneously through and out of the passage 8. When using a striping paste: main paste viscosity ratio of 2:3, a striped stream may be produced in which the volume ratio of striped paste to main paste is about 1:3.

In the second form of nozzle according to the invention shown in FIG. 4, the interior end 12 of the insert is provided with a groove 20 and an externally tapered end 21. A thin PVC film 22 of approximately cylindrical configuration separates the main paste 18 from the striping paste 17 and is anchored to the groove 20 by means of a reinforcing ring 23 surrounding a hole in the hemispherical closed end 25 of the cylindrical film 22. When the tube 15 is squeezed, the main paste body forces the closed end 25 of the cylindrical film 22 against the striping paste 17, and toward the nozzle 14, while the wall of the cylindrical film 22 is forced against the internal wall of the tube 15.

The anchor between the ring 23 and the groove 20, coupled with the contact between the cylindrical film 22 and internal wall of the tube 15, prevents any interaction between the main paste body 18 and striping paste 17 until they issue from the nozzle 14 as a striped stream.

In the modified nozzle arrangement shown in FIG. 5, the nozzle insert 1 is as shown in FIGS. 1–3 or FIG. 4. The aluminium wall 26 of the tube 15 extends inside the nozzle 14 as a sleeve 27 stopping just short of the top of the nozzle 14. The lips 7 at the exterior end 5 of the insert 1 abut the top edge of the aluminium sleeve 27 such that the exterior face 5 of the insert 1 is coplanar with the top edge of the nozzle 14. This enables a particularly good seal to be achieved across the face 5 of the insert when a screw cap (not shown) is fitted to the nozzle 14.

It will be appreciated that, in all the nozzle arrangements shown in FIGS. 3–5, a screw cap may be fitted to the nozzle 14 and will provide an effective seal between the grooves 4 and the channel 8, and thus between the striping paste 17 and the main paste body 18, when the dispenser is closed.

If the two pastes inside the tube constitute the pharmaceutical composition of European Patent Application, Publication No. EP 0 151 953A, then striped stream may be applied topically and the two pastes mixed in situ to obtain the required supersaturated drug system.

We claim:

1. A nozzle insert for a squeezable tube or other dispenser to dispense a striped paste therefrom comprising a hollow cylindrical body having an open proximal end and an open distal end; said hollow cylindrical body having a first axial part and a second axial part; the external cylindrical surface of said first axial part being formed with a plurality of raised circumferentially spaced plateau regions commencing at said proximal end and extending axially therefrom, said plateau regions being separated from each other by grooves formed in said external cylindrical surface of said first axial part and commencing at said proximal end and extending axially therefrom, said external surface of said first axial part being uninterrupted along the entire extent of said grooves to prevent communication between pasty materials flowing within said grooves and within said hollow body until said pasty materials flow beyond said proximal end; and said second axial part has a smoothly cylindrical external surface.

2. A nozzle insert according to claim 1, in which the ratio of the total cross-sectional area of the grooves to the internal cross-sectional area of the insert is from 1:5 to 1:3.

3. A nozzle insert according to claim 1, in which the second axial part is of greater axial length than is the first axial part.

4. A nozzle insert according to claim 1, in which a line extending longitudinally along the bottom of each groove of the first axial part is co-linear with the outer surface of the second axial part.

5. A nozzle insert according to claim 1, in which the junction between each plateau region of the first axial part and the outer surface of the second axial part is chamfered.

6. A nozzle insert according to claim 1, in which the external end of each plateau region carries an outturned lip.

7. A nozzle insert according to claim 1, in which the interior wall of the insert is smoothly cylindrical.

8. A nozzle insert according to claim 1, in which there are from 2 to 12 equally sized grooves.

9. A nozzle insert according to claim 1, in which the ratio of the total cross-sectional area of the grooves to the internal cross-sectional area of the insert is from 1:12 to 1:2.

10. A dispenser for pasty material, having provided with a nozzle insert according to claim 1, the dispenser being designed to dispense a first pasty material through the grooves of the insert and a second pasty material through the centre of the insert.

11. A nozzle insert according to claim 1, in which there are from 4 to 10 equally sized grooves.

* * * * *

UNITED STATES PATENT AND TRADEMARK OFFICE

CERTIFICATE OF CORRECTION

PATENT NO. : 4,842,164

DATED : June 27, 1989

INVENTOR(S) : Adrian Francis Davis and Peter Ridgway Watt

It is certified that error appears in the above-identified patent and that said Letters Patent is hereby corrected as shown below:

Title page:

In item [75], the name of the second inventor should read --Peter Ridgway Watt--.

Signed and Sealed this

Twenty-ninth Day of May, 1990

*Attest:*

HARRY F. MANBECK, JR.

*Attesting Officer*

*Commissioner of Patents and Trademarks*